US007658285B2

(12) United States Patent
Hagan, III et al.

(10) Patent No.: US 7,658,285 B2
(45) Date of Patent: Feb. 9, 2010

(54) ARTICLE SHIPPING AND/OR STORAGE CONTAINER AND A SHIPPING AND/OR STORAGE CONTAINER HAVING ARTICLES

(75) Inventors: Francis M. Hagan, III, Glenshaw, PA (US); Lawrence A. DePaolis, Gibsonia, PA (US); John Leo Flick, Decatur, IL (US); John P. Marshall, III, Oak Creek, WI (US); Alexander S. Sobkin, Wexford, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 456 days.

(21) Appl. No.: 11/740,022

(22) Filed: Apr. 25, 2007

(65) Prior Publication Data

US 2008/0264825 A1 Oct. 30, 2008

(51) Int. Cl.
*B65D 85/48* (2006.01)

(52) U.S. Cl. ..... 206/448; 206/451; 206/453; 108/55.5

(58) Field of Classification Search ..... 206/597, 206/448, 449, 451, 453, 454, 586; 248/345.1, 248/346.03, 346.06; 108/55.1, 55.3, 55.5
See application file for complete search history.

(56) References Cited

U.S. PATENT DOCUMENTS 1,836,362 A * 12/1931 Crowley ..... 211/41.14
3,310,273 A * 3/1967 Seymour ..... 248/346.03
5,174,448 A * 12/1992 Flaig ..... 206/386
5,411,360 A 5/1995 Hilliker et al. ..... 414/608
5,676,066 A 10/1997 Cavalier et al. ..... 108/55.1
5,803,257 A * 9/1998 Bartholomew ..... 206/454
6,098,804 A * 8/2000 Bartholomew ..... 206/451
6,216,607 B1 * 4/2001 Cuddy ..... 108/55.5
6,247,601 B1 6/2001 Norton et al. ..... 211/41.14
6,536,607 B1 3/2003 Knoll et al. ..... 211/41.14
6,705,466 B2 * 3/2004 Bartholomew et al. ..... 206/454
6,820,752 B2 11/2004 Jeskey et al. ..... 211/41.14

* cited by examiner

*Primary Examiner*—Jacob K Ackun, Jr.
(74) *Attorney, Agent, or Firm*—Andrew C. Siminerio

(57) ABSTRACT

A sheet shipping and storage container includes a base supporting a stack of glass sheets in a vertical orientation, and a pair of telescoping end caps mounted on each side of the stack in facing relationship to one another. A first endless strap has its course around the end caps to bias the end caps toward one another about the stack; a second endless strap has it course around back end of each end caps and the back side of the stack to bias the back surface of the stack and the end caps downward toward the front of the base, and a third endless strap around the opposite end of the end caps and the front side of the stack to bias the end caps and the front side of the stack downward toward back side of the base to unitize the plurality of sheets, end caps and base.

29 Claims, 12 Drawing Sheets

ARTICLE SHIPPING AND/OR STORAGE CONTAINER AND A SHIPPING AND/OR STORAGE CONTAINER HAVING ARTICLES

BACKGROUND OF THE INVENTION

1. Field of the Invention

This invention relates to an article shipping and/or storage container, and to a shipping and/or storage container having articles, e.g. flat sheets, and more particularly, to a shipping and/or storage container having a base and end caps, the end caps and base are biased toward one another about a plurality of flat glass sheets to maintain the glass sheets in a vertical position and to unitize the base, end caps and glass sheets.

2. Discussion of the Technical Problem

The design of containers for shipping articles, e.g. and not limiting to the discussion, flat glass sheets has evolved in the last thirty five years to reduce the cost of storage and/or shipment of the glass sheets, and to address environmental concerns. More particularly, the shipping containers were initially made of wood and designed for ease of loading the sheets into, and unloading the sheets out of, the shipping containers, and to protect the sheets during shipment and/or storage. To eliminate or reduce the waste disposal concerns, many of the wood containers have been replaced by returnable metal containers.

Although the returnable metal containers provided a solution to the waste disposal problem, it raised other concerns. These concerns included the need for storage areas for the empty containers at the supplier's and customer's facilities, and the transportation of empty containers from the customer's, to the supplier's, faculties. One of several solutions to overcome these concerns was to design containers that were stackable, followed by designing containers that were collapsible and stackable.

Although containers are presently available to meet the present day requirements, e.g. containers that are collapsible, stackable, and protect the sheets against physical damage during shipment and/or storage, it is appreciated by those skilled in the art that it would be economically advantageous to provide a container that is collapsible and stackable into a smaller volume than the presently available containers; protects the sheets against physical damage during shipment and/or storage; and has a minimal amount of disposable material.

SUMMARY OF THE INVENTION

This invention relates to a base for shipping and/or storing a plurality of articles e.g. a plurality of flat glass sheets. In one non-limiting embodiment of the invention, the base includes a support platform having a first side, an opposite second side, a third side between the first and second sides, and a fourth side opposite to the third side. The base further includes first and second end restraints. The first end restraint includes a first end, an opposite second end, a supporting surface defined as a first supporting surface between the first and second ends of the first end restraint, a stop plate defined as a first stop plate extending above the supporting surface, a band retention member defined as a first band retention member adjacent the first end of the first restraint, and a band retention member defined as a second band retention member adjacent the second end of the first end restraint. The second end restraint includes a first end, an opposite second end, a supporting surface defined as a second supporting surface between the first and second ends of the second end restraint, a stop plate defined as a second stop plate extending above the supporting surface, a band retention member defined as a third band retention member adjacent the first end of the second restraint member, and a band retention member defined as a fourth band retention member adjacent the second end of the second end restraint. A first elongated member has one end connected to the first end restraint and an opposite second end slidably mounted in first end of the first side or the second side of the base to move the first restraint toward and away from the third side of the base, and a second elongated member has one end connected to the second end restraint and an opposite second end slidably mounted in opposite second end of the first or the second side of the base to move the second end restraint toward and away from the fourth side of the base.

The invention further relates to an end cap for a shipping and/or storage container. In one non-limiting embodiment of the invention, the end cap includes telescoping first and second sections. The first section includes a shroud defined as a first shroud having a cavity formed by an end wall joined to a front wall, and a top wall joined the first and second walls, and a U-shaped member defined as first U-shaped member having an elongated first member, an elongated second member and a third member joining the first and second members to form the first U-shaped member, the first U-shaped member is secured in the cavity of the first shroud with the third member of the first U-shaped member adjacent the end wall of the first shroud and the first leg member of the first U-shaped member adjacent the top wall of the first shroud. The second section includes a shroud defined as a second shroud having a cavity formed by an end wall joined to a front wall, and a top wall joined the end wall and the front wall, and a U-shaped member defined as second U-shaped member having an elongated first member, an elongated second member and a third member joining the first and second members to form the second U-shaped member, the second U-shaped member is secured in the cavity of the second shroud with the third member of the second U-shaped member adjacent the end wall of the second shroud and the first leg member of the second U-shaped member adjacent the top wall of the second shroud. The top wall and the front wall of the first shroud, and the top wall and front wall of the second shroud are sized relative to one another such that inner surface of the top wall of the first shroud can slide over outer surface of the top wall of the second shroud to move edge of the top wall of the first shroud toward and away from the side wall of the second shroud and edge of the top wall of the second shroud toward and away from the side wall of the first shroud.

The invention still further relates to a container having the base and/or end caps of the invention to of unitized articles, e.g. a plurality of flat glass sheets. In one non-limiting embodiment of the invention the container includes a base having a first base corner, a second base corner, a third base corner and a fourth base corner, and a plurality of articles stacked on the base. The stack of articles have a bottom surface on the base, a top surface opposite the bottom surface, a first surface, a second surface opposite to the first surface, a third surface between the first and second surfaces, and a fourth surface opposite to the third surface. A first stack corner is at the juncture of the top surface, the first surface and the fourth surface, and is adjacent to and above the first base corner; a second stack corner is at the juncture of the top surface, the first surface and the third surface and is adjacent to and above the second base corner; a third stack corner is at the juncture of the top surface, the second surface and the fourth surface and is adjacent to and above the third base corner, and a fourth stack corner is at the juncture of the top surface, the second surface and the third surface, and is adjacent to and above the fourth base corner. A first end cap is mounted on marginal edge portions of the top surface of the stack adjacent the fourth side of the stack, over upper marginal edge portions of the fourth side, and over the first and third stack corners, and a second end cap is mounted on marginal edge portion of the top surface of the stack adjacent the third side, over upper marginal edge portion of the third side, and over the second and fourth stack corners. A first biasing force biases the first and second end caps toward one another, biases the first end cap against the marginal edge portions of the first, second and fourth sides of the stack and biasing the second end cap against the first, second and third sides of the stack; a second biasing force acting on the first end cap and the base biases the first stack corner toward the third base corner; a third biasing force acting on the first end cap and the base biases the third stack corner and the first base corner toward one another; a fourth biasing force acting on the second end cap and the base biases the second stack corner and the fourth base corner toward one another, and a fifth biasing force acting on the second end cap and the base biases the fourth stack corner and the second base corner toward one another wherein the first, second, third, fourth, and fifth biasing forces unitizes the plurality of articles, the first and second end caps, and the base.

DESCRIPTION OF THE INVENTION

Figure 1:
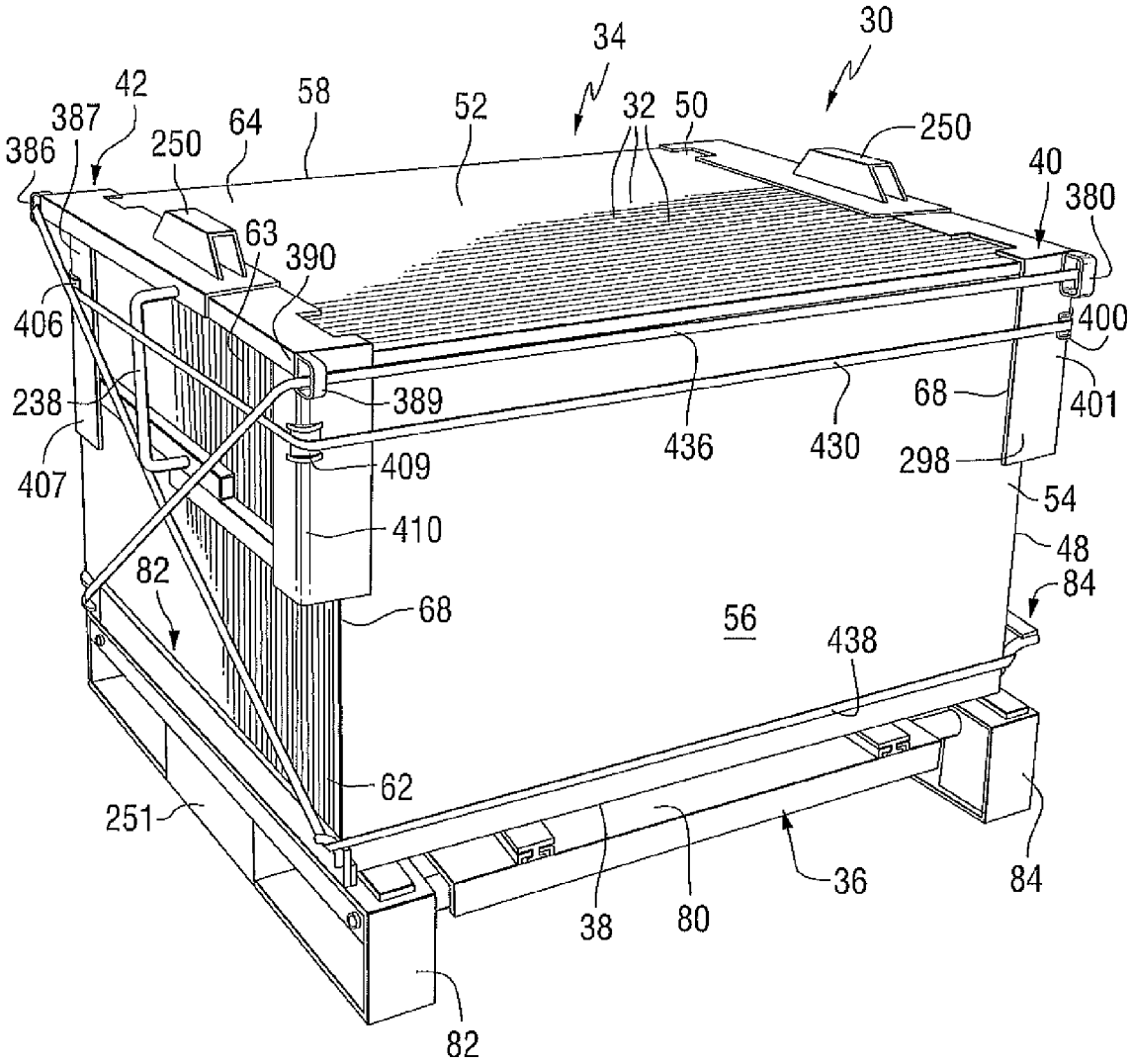
FIG. 1 is a perspective view of a non-limiting embodiment of a loaded container of the invention.

As used herein, spatial or directional terms, such as "inner", "outer", "left", "right", "up", "down", "horizontal", "vertical", "front", "back" and the like, unless indicated otherwise, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between, and inclusive of, the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the terms "deposited over", "applied over", or "provided over" mean deposited, applied, or provided on but not necessarily in surface contact with. For example, a material "deposited over" a surface of a sheet or substrate does not preclude the presence of one or more other materials of the same or different composition located between the deposited material and the surface of sheet or substrate.

Before discussing non-limiting embodiments of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise in the following discussion, like numbers refer to like elements.

The non-limiting embodiments of the container of the invention are described for shipping and/or storing flat glass sheets. The invention, however, is not limited thereto, and the container of the invention can be used to ship and/or store flat sheets of any material, e.g. but not limited to wood, metal and plastic; to ship and/or store monolithic or laminated sheets, e.g. but not limited to a pair of glass sheets, plastic sheets or glass and plastic sheets secured together by an interlayer material; to ship and/or store double or triple glazed insulating units, e.g. but not limited to units having sheets separated by, and secured to a spacer; to ship and/or store sheets having curved major surfaces; to ship and/or store sheets having straight edges or contoured edges, and to ship and/or store articles, e.g. but not limited to boxes or cartoons having merchandise therein.

Figure 2:
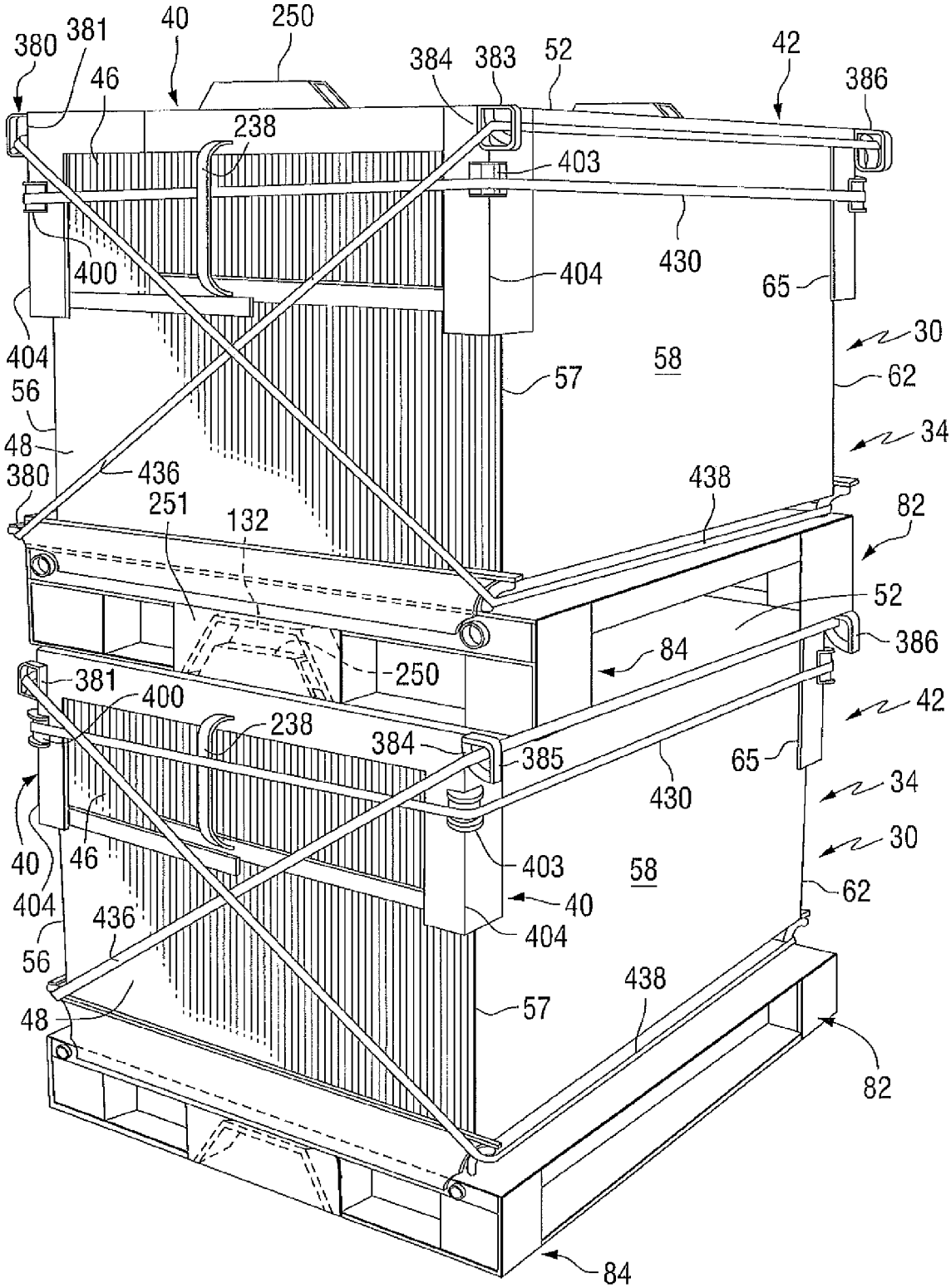
FIG. 2 is an isometric view of two loaded containers of the invention stacked one on top of the other in accordance to the teachings of the invention. The containers shown in FIG. 2 are rotated 180 degrees from the position of the container shown in FIG. 1.

Shown in FIG. 1 is a non-limiting embodiment of a container or rack 30 of the invention loaded with a plurality flat glass sheets 32 arranged and secured in a stack 34 in accordance to the teachings of the invention. The container 30 includes a base 36 to support the sheets 32, e.g. support bottom surface 38 of the stack 34, a first end cap or end restraint 40, and a second end cap or end restraint 42 in facing relationship to the first end cap 40. With reference to FIGS. 1 and 2 as needed, the first end cap 40 engages upper marginal edge portions 46 of side 48 of the stack 34 (see FIG. 2), marginal edge portions 50 of top surface 52 of the stack 34 adjacent the side 48, marginal edge portions 54 of side or first outermost sheet 56 of the stack 34 (see FIG. 1), and marginal edge portions 57 (see FIG. 2) of the opposite side or opposite second outermost sheet 58 of the stack 34. The second end cap 42 (see FIG. 1) at opposite side 62 of the stack 34 and in facing relationship to the first end cap 40 engages upper marginal edge portions 63 of the side 62 of the stack 34, marginal edge portions 64 of the top surface 52 of the stack 34 opposite to the marginal edge portions 50 of the top surface 52 and adjacent the side 62, marginal edge portions 65 (see FIG. 2) of the side or second outermost sheet 58 of the stack 34, and marginal edge portions 68 of the first outermost sheet 56 of the stack 34 adjacent the side 62 (see FIG. 1). The end caps 40 and 42, the base 36 and the plurality of sheets 32 are biased toward one another in a manner discussed below to unitize the base, the end cap and the stack 34 of the sheets 32.

Figure 3:
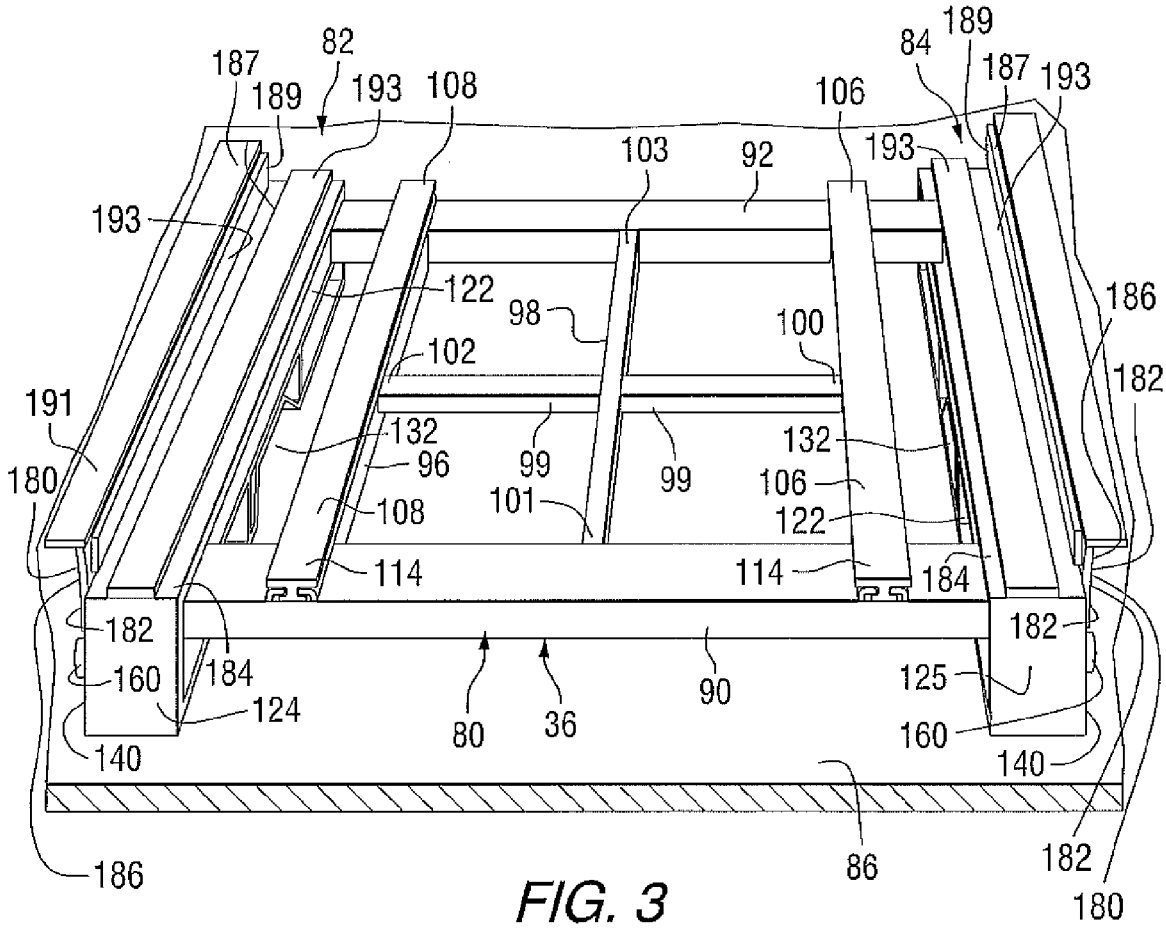
FIG. 3 is a front perspective view of a non-limiting embodiment of a base of the invention used in the container shown in FIG. 1.
Figure 4:
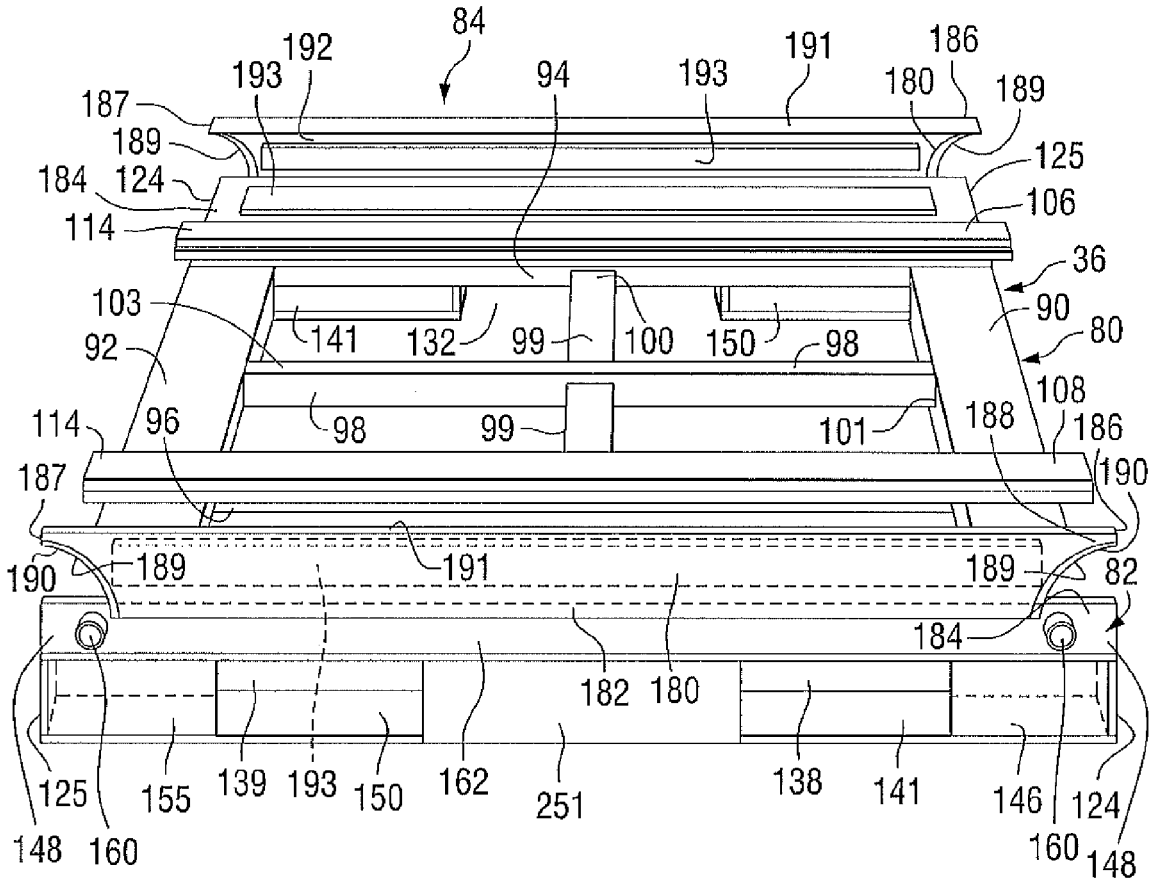
FIG. 4 is an end perspective view of the base shown in FIG. 3.

With reference to FIGS. 1, 3 and 4 as needed, in one non-limiting embodiment of the invention, the base 36 includes a support platform 80 and a pair of sheet edge support and restraint members 82 and 84 (hereinafter also referred to as "restraint members" 82 and 84) connected to the support platform 80 for movement toward and away from the support platform 80 in a manner discussed below to accommodate glass sheet stacks 34 of different lengths, e.g. as measured between the sides 48 and 62 of the stack 34 (see FIG. 1). For ease of discussion and reference, but not limiting to the invention, the first outermost sheet 56 (see FIG. 1) is at the front of the loaded container 30 and the second outermost sheet 58 (see FIG. 2) is at the rear of the container.

Figure 5:
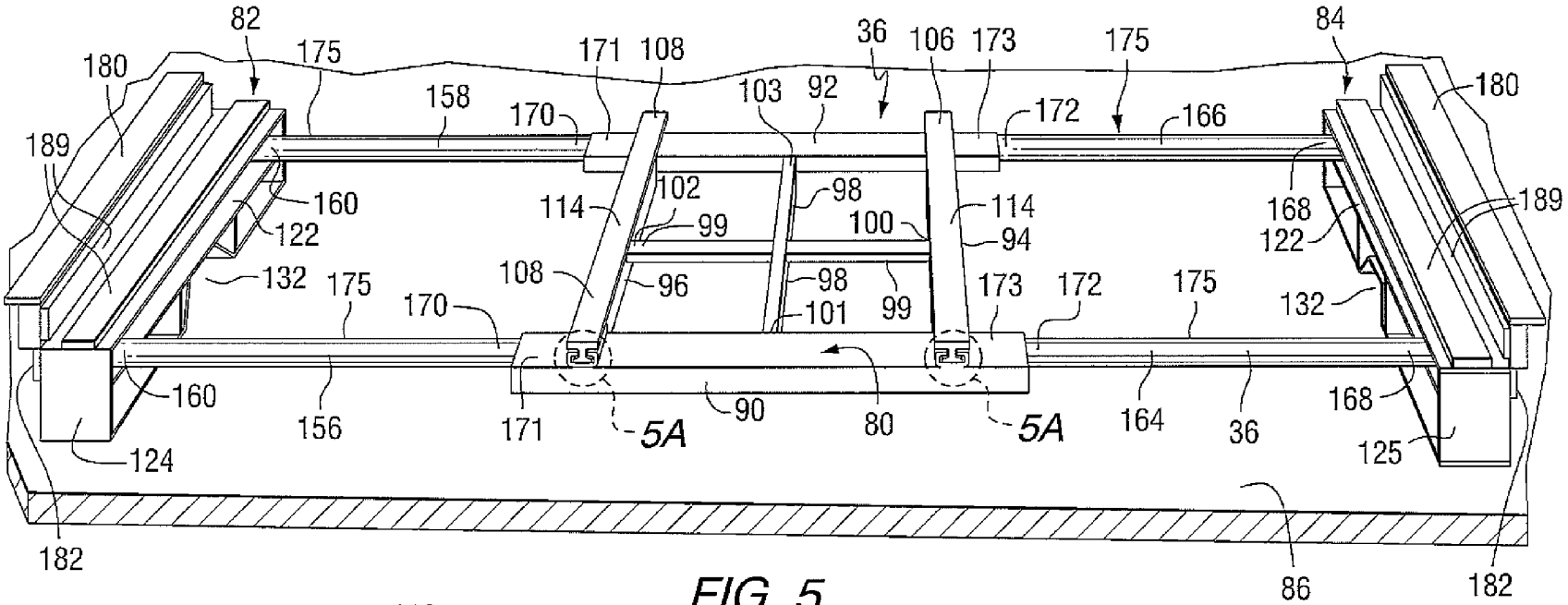
FIG. 5 is a view similar to the view of FIG. 3 showing the base in the expanded position.
Figure 5A:
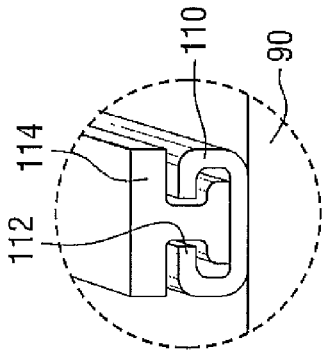
FIG. 5A is an enlarged end view of a sheet supporting member of the base.

With reference to FIGS. 3-5 as needed, in one non-limiting embodiment of the invention, the sheet support platform 80 of the base 36 includes a first outer front strut 90, an opposite second rear strut 92, a right side strut 94 (see FIG. 4) and an opposite left side strut 96 joined together in any conventional manner to provide an outer frame for the sheet support platform 80. In one non-limiting embodiment of the invention, the struts 90, 92, 94 and 96 are pieces of rectangular shaped metal tubing welded together to form the outer frame of the sheet support platform 80. Metal cross members 98 and 99 between the struts 90, 92, 94 and 96 are joined together to form an "X" or a "+" with ends 100 and 102 of the metal cross members 99 connected, e.g. welded to struts 94 and 96, respectively, and with ends 101 and 103 of the metal cross member 98 connected, e.g. welded to the struts 90 and 92, respectively for added structural strength. Securely mounted on each of the struts 94 and 96 is a sheet edge support member or runner 106 and 108, respectively, to support the bottom surface 38 of the stack 34 of sheets 32, i.e. support the bottom edges of the sheets 32 as stacked on the runners 106 and 108. With reference to FIGS. 5 and 5A, in one non-limiting embodiment of the invention, the runners 106 and 108 each include a metal elongated hollow member 110 having a slot 112 to capture inverted T-shaped sheet contact member 114. The sheet contact member 114 supports portions of the bottom edges of sheets or bottom surface 38 of the stack of sheets (see FIG. 1) and is preferable made of resilient material, e.g. but not limiting to the invention, rubber to prevent physical damage to the edges of the sheets, e.g. edge chipping of the glass sheets while preventing movement of the sheet along the surface of the sheet contact members 114.

Figure 6:
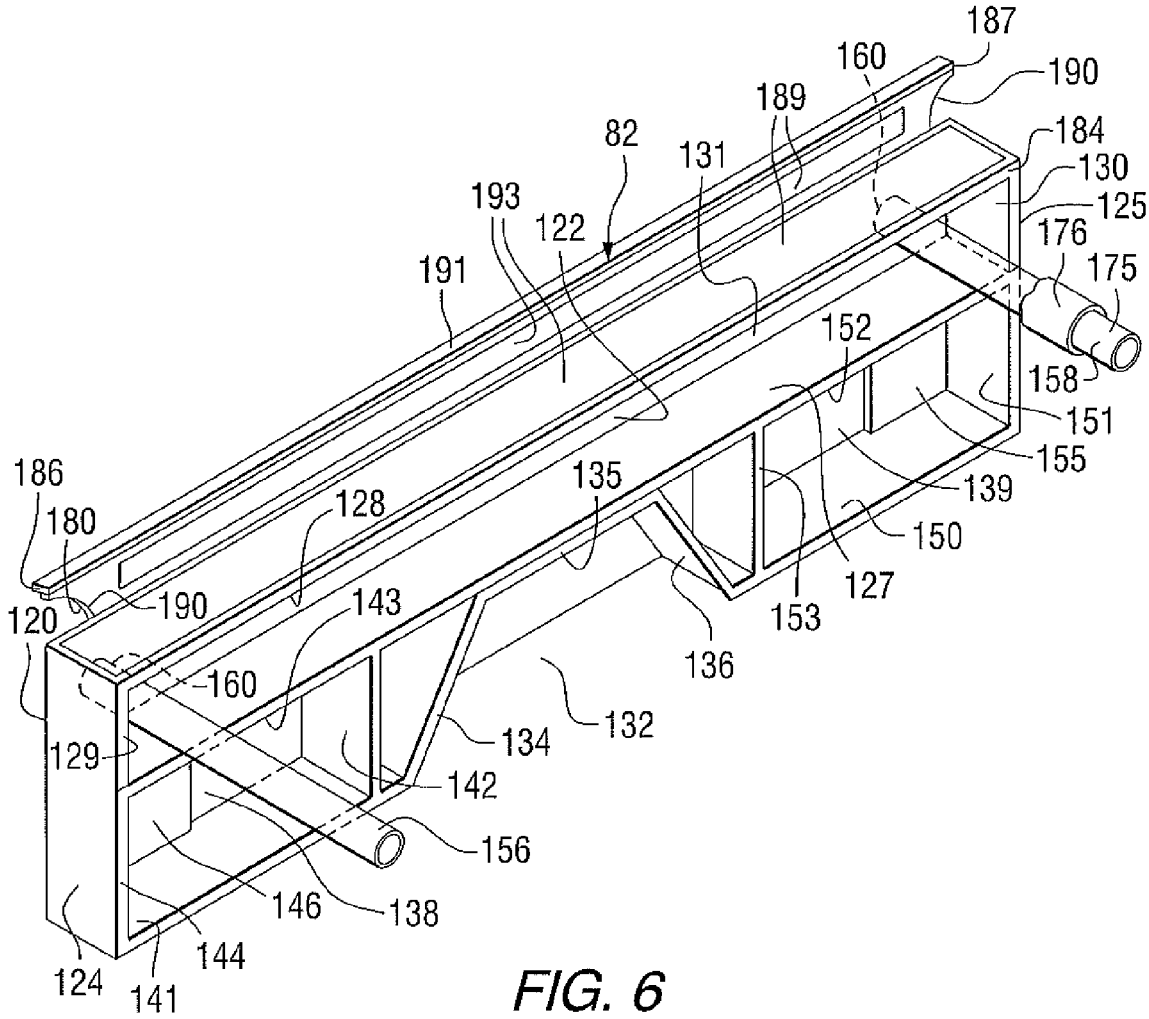
FIG. 6 is a side perspective view of a non-limiting embodiment of an end restraint of the invention used with the base shown in FIGS. 3-5.

The sheet support and restraint members 82 and 84 are similar in construction and in a facing relationship to one another. The discussion is directed to the restraint member 82 shown in FIG. 6, and the discussion is applicable, unless indicated otherwise, to the restraint member 84. In one non-limiting embodiment of the invention, the restraint member 82 is made of ¼ inch thick metal plate shaped to provide the restraint member 82 with a generally rectangular housing 120 having an upper compartment 122 defined by wall surfaces 127-130, the compartment 122 extends between sides 124 and 125 of the housing 120; a bottom center concave portion 132 defined by wall portions 134-136, the concave portion 132 is used for stacking loaded containers one on top of the other (see FIG. 2) in a manner discussed below, and a passageway 138 and 139 on each side of the concave portion 132 for receiving forks of a fork lift truck (not shown). With reference to FIGS. 4 and 6, the passageway 138 is defined by wall surfaces 141-144 (see FIG. 6) and a plate 146 (see FIGS. 4 and 6) securely mounted over a portion of outside surface 148 of the housing 120 adjacent the side 124 of the housing 120, and the passageway 139 is defined by wall surfaces 150-153 and a plate 155 securely mounted over a portion of the outside surface 148 of the housing adjacent the side 126 of the housing 120. The plates 146 and 155 provide structural stability to the restraint member 82 and reduce the size of the opening of their respective one of the passageways 138 and 139 to limit movement of the forks of the fork lift truck in the passageways and to position center portion of the base 36 on the forks of the fork lift truck.

Referring back to FIG. 5, the support and restraint members 82 and 84 are connected to the sheet support platform 80 for movement toward and away from the support platform 80 in any convenient manner. In one non-limiting embodiment of the invention, a pair of elongated circular rods 156 and 158 had one end 160 secured to outer wall 162 of the upper compartment 122 of the edge support 82 (see FIG. 4), and a pair of elongated rods 164 and 166 had one end 168 secured to the outer wall of the restraint member 84 (not shown). The opposite end portions 170 of the rods 156 and 158 were slidably mounted in end 171 of the front strut 90 and the rear strut 92, respectively of the sheet support platform 80, and opposite end portions 172 of the rods 164 and 166 were slidably mounted in opposite end 173 of the front strut 90 and the back strut 92, respectively of the sheet support platform. The end portions 170 and 172 of the rods 156, 158 and 164, 166, respectively can be slidably mounted in their respective one of the struts 90 and 92 in any convenient manner, for example, but not limiting to the invention by providing a conduit into which the rods can move or have a keyway formed in the rods and the internal passageway of the struts. In one non-limiting embodiment of the invention, the ends 160 of the rods 156 and 158, and the ends 168 of the rods 164 and 166 can extend through the wall surface 131 of the upper compartment 122 of the housing 120 of the end restraints 82 and 84, e.g. as shown for the ends 160 of the rods 156 and 158 of the end restraint 82 in FIGS. 4 and 6.

The length of the support platform 80 as measured between the ends 171 and 172 of the struts 90 and 92, respectively, and the length of the rods 156, 158, 164 and 166 are not limiting to the invention. In one non-limiting embodiment of the invention, the length of the support platform 80 was about equal to the length of each one of the rods 156, 158, 164 and 166. In this manner the rods can be pulled out of their respective strut 90 and 92 to about 50% of their length with at least about 50% remaining in the support platform 80 so that the portion of the rods 156, 158, 164 and 166 in the struts overlap one another to minimize sideward motion of the rods in the struts. In a constructed non-limiting embodiment, the sheet support platform 80 of the base 36 had a length of 39 inches, the rods 156, 158, 164 and 166 had a length of 80 inches, and the maximum length the rods extended out of their respective one of the struts 90 and 92 was 40 inches. The invention contemplates using a stop arrangement, e.g. a collar (not shown) secured on the rods 156, 158, 164 and 166, and engaging a stop surface (not shown) to prevent pulling the rods out of their respective struts to a length greater than the allowable maximum length. Although not limiting to the invention, outer surfaces 175 of the rod 156, 158, 164 and 166, and the passageways (not shown) in the struts 90 and 92 can have a layer 176 of low friction material, e.g. a low friction material of the type sold under the trademark TEFLON (shown only in FIG. 6 and only on the rod 158).

With reference to FIGS. 3 and 4, to prevent physical damage to the corners of the glass sheets 32 supported by the sheet support and restraint members 82 and 84 and to prevent sideward movement of the sheets during transmit, the restraint members 82 and 84 each have a plate member 180 having an end portion 182 secured to outer wall 162 of the restraint members 80 and 82 and extends above upper surface 184 of the housing 120 of the restraint members 82 and 84 (clearly shown in FIG. 4). With continued reference to FIG. 4, opposed ends 186 and 187 of the plate member 180 have a cut out 189 to contain the restraint arrangement that unitizes the sheets 32, the base 36 and the end caps 40 and 42 in a manner discussed below. For ease of changing course of the restraint arrangement, the edge of the cut out 189 is rounded. In one non-limiting embodiment of the invention, a ¼ inch steel rod 190 was welded to the edge of the cut out. Shown in FIG. 3 is a metal rib 191 was welded to the end of the plate member 180 and faces in a direction away from the housing 120 to strengthen the plate member 180. As can be appreciate the plate member 180 can be shaped to have a strengthen rib. In one non-limiting embodiment of the invention and with reference to FIG. 6, the upper surface 184 of the housing 120 of the restraint members 82 and 84 and inner surface 192 of the plate member 180 is provided with a layer 193 of a resilient material, e.g. a layer of rubber adhesively bonded to the plate and the restraint member, to prevent damage to the edges of the glass sheets.

The discussion is now directed to the end caps 40 and 42 of the invention. The end caps 40 and 42 are similar in construction and in the preferred embodiment of the invention the end caps 40 and 42 are designed for use on the right side 48 and the left side 62 (see FIGS. 1 and 2), respectively of the stack 34 of the glass sheets 32. The discussion is directed to the end cap 40 used on the right side of the stack, and the discussion is applicable to the end cap 42 used on the left side of the stack unless indicated otherwise.

Figure 7:
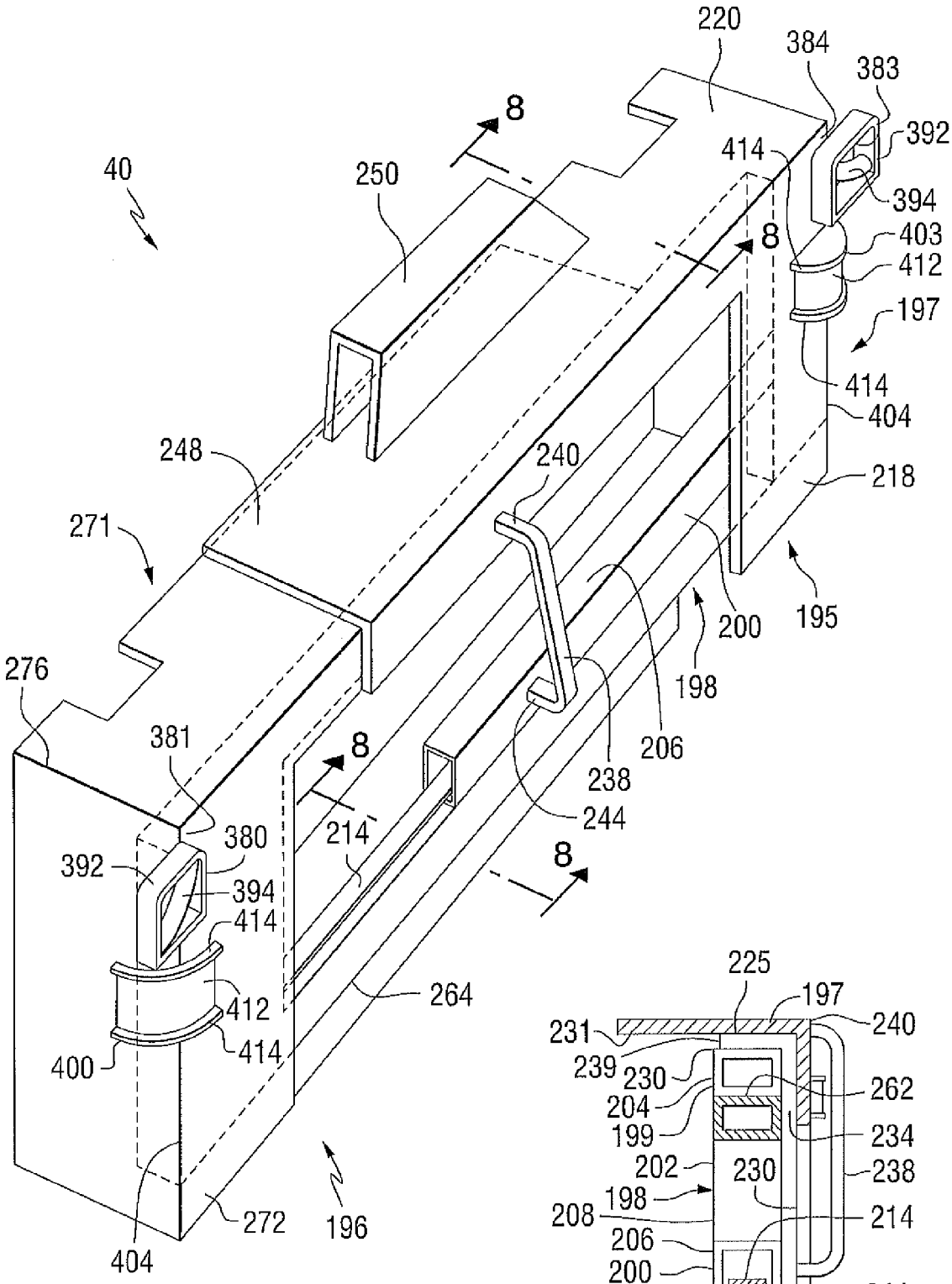
FIG. 7 is a front isometric view of a non-limiting embodiment of an end cap of the invention.
Figure 8:
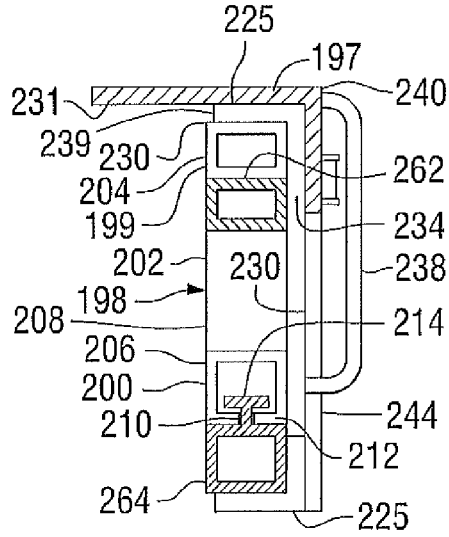
FIG. 8 is a view taken along line 8-8 of FIG. 7.
Figure 9:
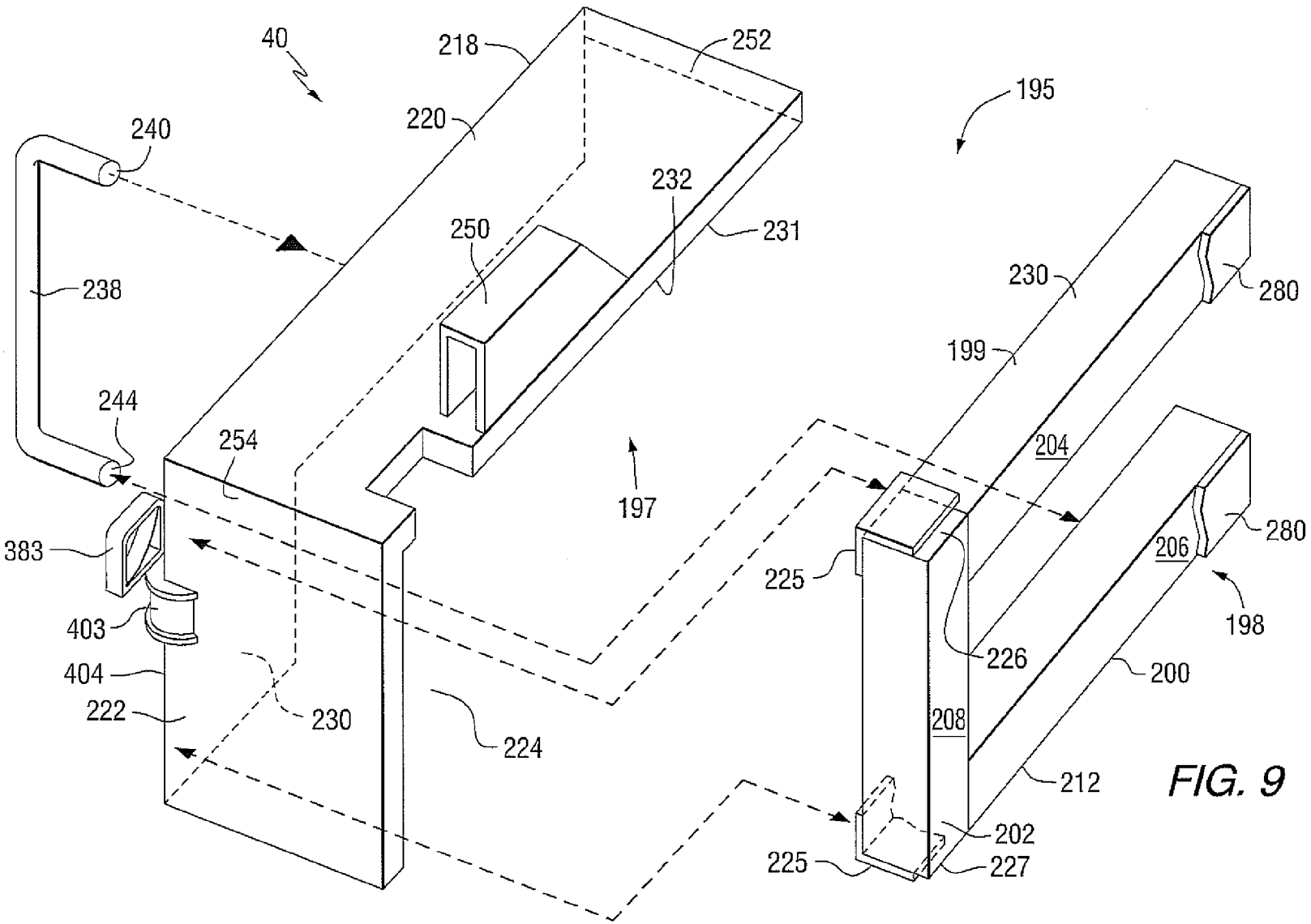
FIG. 9 is a view from the back side of the end cap shown in FIG. 7 showing an exploded view of one of two sections of the end cap.

With reference to FIGS. 7-10 as needed, the end cap 40 has a first section 195 and second section 196 telescoped together to accommodate varying lengths of stacked sheets as measured between the two outermost sheets 56 and 58 (see FIGS. 1 and 2). The first section 195 of the end cap as shown in FIGS. 7 and 9 includes a shroud 197 over selected portions of a U-shaped member 198 secured thereto in any convenient manner, e.g. by welding. The U-shaped member 198 includes a first leg 199 and a second leg 200 joined by a third leg 202. To reduce the weight of the end caps 40 and 42, the legs 199, 200 and 202 are made of hollow rectangular tubing. The invention, however, contemplates one or more of the legs 199, 200 and 202 being solid and/or having the first section 195 of the end caps 40 and 42 in one formed or machined piece, e.g. molded fiber reinforced plastic. Surfaces 204, 206 and 208 of the legs 199, 200 and 202 (shown in FIG. 9), respectively are aligned e.g. lie in a plane (clearly shown in FIG. 8) to uniformly engage the side of the stack 32 of sheets 34. With reference to FIG. 8, the second leg 200 of the U-shaped member 198 has a slot 210 on bottom surface 212 to receive tab 214 of the second section 196 of the end cap (see also FIG. 7). With this arrangement, the sections 196 and 197 of the end caps 40 and 42 can be moved toward and away from one another to adjust to the size of the stack while remaining attached and aligned with one another.

With reference to FIGS. 7 and 9, in one non-limiting embodiment of the invention, the shroud 197 includes a front wall 218, a top wall 220 and a side wall 222 joined together to provide a cavity 224 to receive the U-shaped member 198. The U-shaped member 198 has an angle clip 225 secured at each of the opposite ends 226 and 227 of the leg 202 and optionally over portions of the legs 199 and 202 of the U-shaped member 198 (see FIG. 9), and the angled clips 225 are secured in the cavity 224 of the shroud 194, e.g. by welding the angle clips 225 to inner surface 230 of the cavity 224 of the shroud 197. The angle clips 225 space the first leg 199 of the U-shaped member 198 from inner surface 230 of the front wall 218, and inner surface 232 of the top wall 220, of the shroud 197 (see FIG. 9) to provide a slit 234 (see FIG. 8) to telescope the second section 196, into the first section 195, of the end cap 40. A rigid handle 238 has one end 240 secured to the front wall 218 of the shroud 197 and the other end 244 secured to the second member 200 of the U-shaped member 198 (see FIG. 8). The handle 238 in addition to maintaining the leg 200 in position, also provides a pressure area to move center portion of the end caps 40 and 42 against the side of the stack of glass sheets in a manner discussed below. In another non-limiting embodiment of the invention, the front wall 218 of the shroud 197 covers the first, second and third legs of the U-shaped member 198, however, in the preferred practice of the invention, the shroud 194 only covered the first leg 198 and the third leg 202 to reduce the weight of the end caps 40 and 42.

A pyramidal shaped member or tab 250 is mounted on outer surface 248 of the top side 220 of the shroud 194. The tab 250 is shaped and dimensioned to fit into the inward sloping concave portion 132 of the restraint members 82 and 84 (see FIGS. 2 and 6). With this arrangement, the loaded contains can be aligned with one another as they are stacked one on top of the other. To further assist in aligning the stacked loaded containers, a plate 251 (see FIGS. 2 and 4) was secured over the concave portion 251 of the restraint members 82 and 84 for structural stability and to limit sideward movement of the top container relative to the bottom container. As can now be appreciated, the tab 250 and the concave portion 132 are preferably aligned with one another. In one non-limiting embodiment of the invention, the concave portion is centrally located between the ends 124 and 125 of the restraint members 82 and 82 of the base, and central portion of the tab 250 is spaced from the sidewall 222 of the shroud 197 (see FIG. 9) about ½ the distance between the ends 124 and 125 of the restraint members. In this manner, having the sidewall 222 of the end caps 42 and 40 aligned with their respective one of the sides 125 and 126 of the restraint members 82 and 84 will provide for aligning stacked loaded containers.

Figure 10:
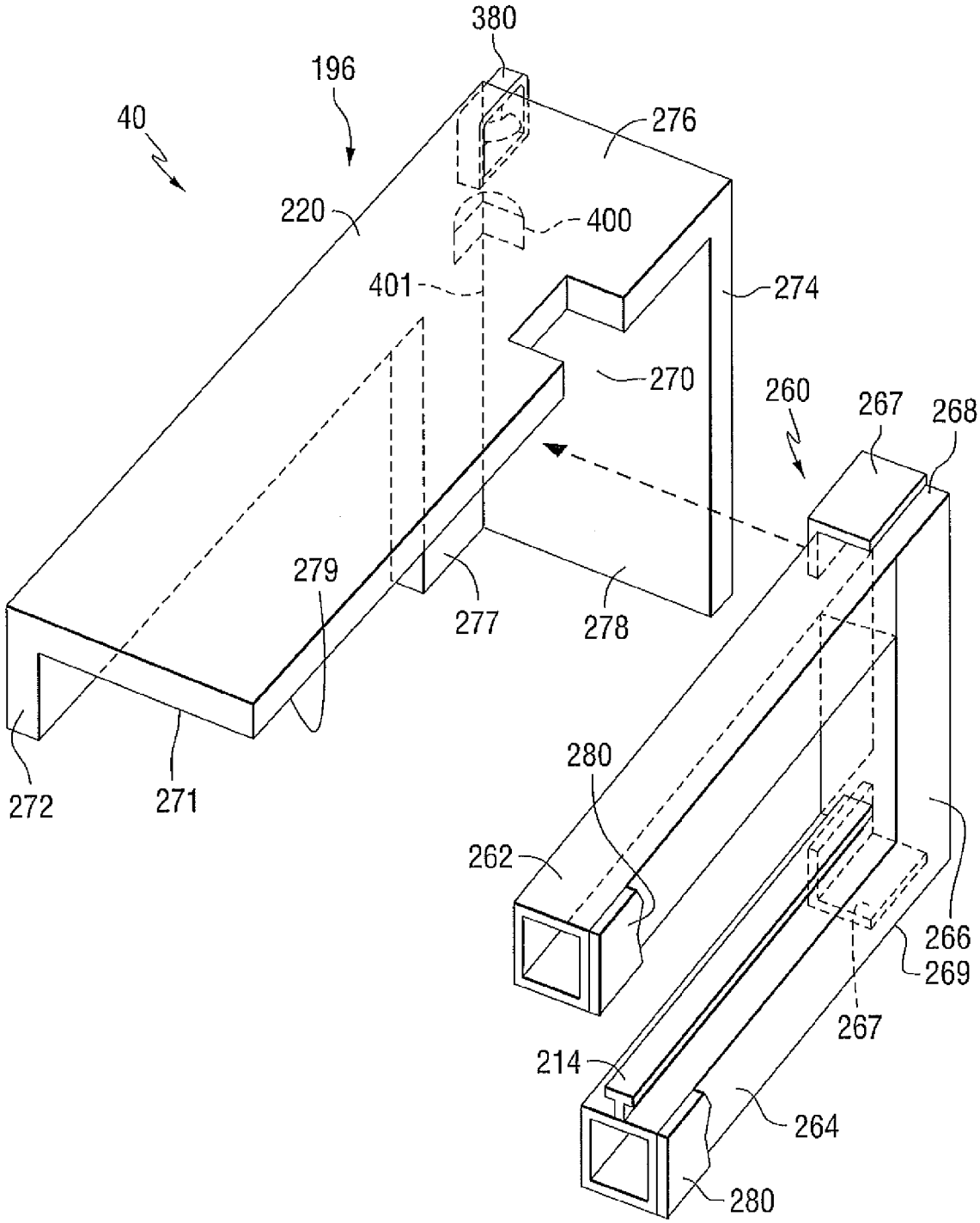
FIG. 10 is a view from the back side of the end cap shown in FIG. 7 showing an exploded view of the second section of the end cap.

With reference to FIG. 10, the second section 196 of the end cap 40 includes a U-shaped member 260 having a first leg member 262, a second leg member 264 having the tab 214 sized to slid in the slot 210 of the second leg member 200 of the first section 190 of the end cap 40 (see FIG. 8), and a third leg member 266 secured to the first and second leg members, e.g. by welding. An angle plate 267 is secured on ends 268 and 269 of the third leg member 266. The U-shaped member 260 is secured in cavity 270 of shroud 271 of the second section 196. The shroud 270 includes a front wall 272, a side wall 274 and a top wall 276. The thickness of the front wall 272 and of the top wall 276 of the shroud 270 are sized to move the front wall 272 and the top wall 276 of the shroud 270 in the slit 234 of the first section 195 of the end caps (see FIG. 8). In one non-limiting embodiment of the invention, the angle plates 267 of U-shape member 260 were secured to inner surface 277 of the front wall 272 adjacent inner surface 278 of the side wall 274 and spaced from the inner surface 278 of the top wall 276 such that the leg member 262 of the U-shaped member 260 was below the leg member 204 of the U-shaped member 198, and the leg member 264 of the U-shaped member was below the leg member 200 of the U-shaped member 198 with the tab 214 of the leg member 264 in the slot 210 of the leg member 200 as shown in FIG. 8. The surface of the U-shaped members engaging the glass preferably lie in the same plane (see FIG. 8), and all surfaces of the end caps contacting the sheets 32 in a preferred embodiment of the invention had a layer 280 of a resilient material, e.g. rubber or polyurethane (see FIGS. 9 and 10 to prevent damage to the glass sheets.

With reference to FIGS. 7 and 8, when the first and second sections 195 and 196 of the end caps 40 and 42 are joined, the front wall 272 and the top wall 276 of the shroud 271 of the second section 196 moves in the slot 234 of the first section 195, the leg member 262 of the U-shaped member 260 moves below the leg member 199 of the U-shaped member 198, and the tab 214 of the leg member 264 of the U-shaped member 260 moves in the slot 210 of the leg member 200 of the U-shaped member 198. As can be appreciated the metal surfaces can have a layer of low friction material discussed above to aid in the components of the end caps 40 and 42 sliding relative to one another.

With reference to FIGS. 11-14 as needed, there is shown another non-limiting embodiment of an end cap of the invention designated by the number 300. For the sake of clarity and not limiting the invention thereto, the orientation of the end cap 300 corresponds to the orientation of the end cap 40 on the stack 34 of glass sheets 32 (see FIGS. 1 and 2), and there was fabricated an end cap (not shown) having the embodiments of the end cap 300 and the orientation of the end cap 42 on the stack 34 of the glass sheets 32.

Figure 11:
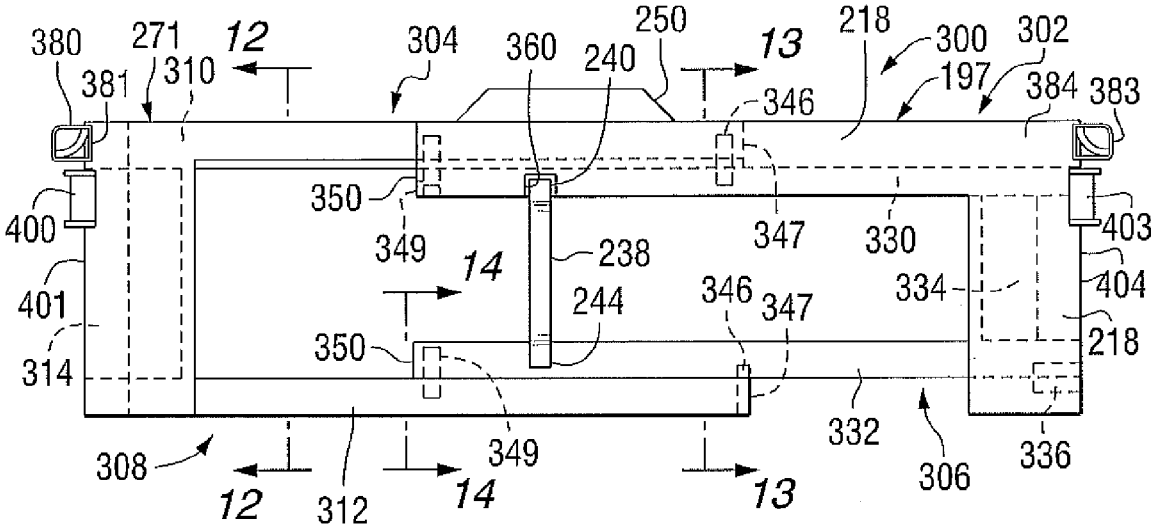
FIG. 11 is an elevated front view of another non-limiting embodiment of an end cap of the invention.
Figure 12:
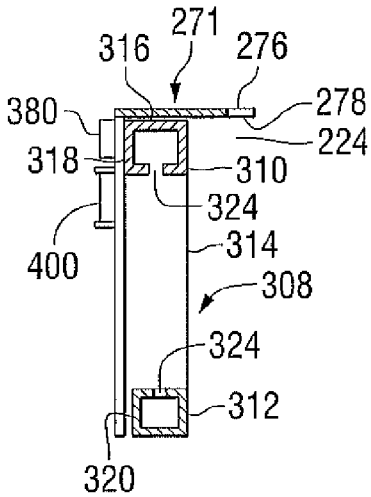
FIG. 12 is a view taken along lines 12-12 of FIG. 11.

The end cap 300 included a first section 302 and a second section 304. The first section 302 included the shroud 197 of the first section 195 of the end caps 40, and a U-shaped member 306 secured in the cavity 224 of the shroud 197. The second section 304 included the shroud 271 of the second section 196 of the end cap 40 and a U-shaped member 308 in the cavity 224 of the shroud 271. With reference to FIGS. 11 and 12, the U-shaped member 308 had a first leg member 310 and a second leg member 312 each secured to a third leg member 314 to provide the U-shape. Upper surface 316 of the first leg member 310 was adjacent to the inner surface 278 of the top wall 276, and side surface 318 of the first leg member 310, and side surface 320 of the second leg member 312 were secured to the inner surface 277 of the side wall 272 of the shroud 271 and the third leg member 314 secured to the inner surface 278 of the end wall 274 of the shroud 271. With continued reference to FIG. 12, each of the leg members 310 and 312 of the U-shaped member 308 facing one another had a groove 324 extending along their length with the grooves 324 facing one another. The grooves 324 in the legs member 310 and 312 of the U-shaped member 308 are used to maintain the first section 302 and the second section 304 of the end cap 300 together in a manner discussed below.

Figure 13:
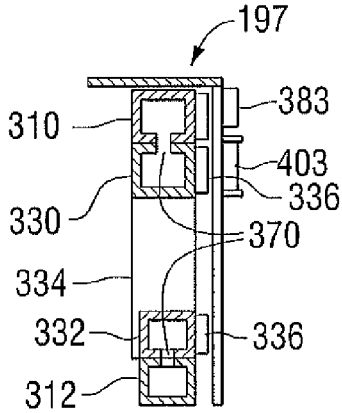
FIG. 13 is a view taken along lines 13-13 of FIG. 11.

With reference to FIGS. 11 and 13, the U-shaped member 306 of the first section 302 of the end cap 300 included a first leg member 330 and a second leg member 332 secured to a third leg member 334 to provide the U-shape. An angle clip 336 was secured on portions of the first and second leg members 330 and 332 adjacent the third leg member 334 of the U-shaped member 306 and welded to the inner surface 230 of the front wall 218 of the shroud 197. With this arrangement, the surfaces of the U-shaped members 306 and 308 in surface engagement with the sheets 32 were generally aligned with one another, e.g. lying in the same plane. The first and second leg members 330 and 332 each had a groove 370 extending along their length on surface of the first and second leg members 330 and 332, respectively facing away from one another as shown in FIG. 13. The U-shape members 306 and 308 were sized such that the first and second leg members 330 and 332, respectively of the U-shaped member 306 were between the first and second leg members 310 and 312, respectively of the U-shaped member 308 as shown in FIGS. 11 and 13.

Figure 14:
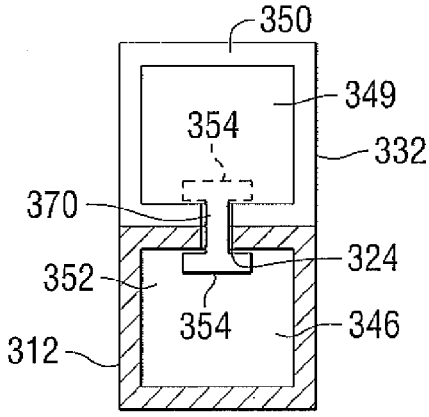
FIG. 14 is a view taken along lines 14-14 of FIG. 11.

With reference to FIGS. 11 and 14, the leg members 310 and 312 of the U-shaped member 308 were joined to the leg members 330 and 332 of the U-shaped member 308, respectively by securing a cap 346 in free end 347 of each of the first and second leg members 310 and 312 of the U-shaped member 308, and a cap 349 in free end 350 of each of the first and second leg members 330 and 332, respectively of the U-shaped member 306. With specific reference to FIG. 14, the caps 346 and 349 were identical in construction and each had a plate section 352 and a T-shaped tab section 354 extending away from the plate section 352. The plate sections 352 of the caps 346 were welded in their respective one of the free ends 347 of the first and second leg members 310 and 312, respectively of the U-shaped member 308 with the T-shaped tab sections 354 of the caps 346 captured in the groove 370 of the first and second leg members 330 and 332, respectively of the U-shaped member 306. The plate sections 352 of the caps 349 were welded in their respective one of the free ends 350 of the first and second leg members 330 and 332, respectively of the U-shaped member 306 with the T-shaped tab sections 354 of the caps 349 captured in the groove 324 of the first and second leg members 310 and 312, respectively of the U-shaped member 308. With this arrangement the first and second sections 302 and 304 of the end cap 300 can telescope with one another while the sections of the end cap were secured together.

With reference to FIG. 11, the handle 238 has the end 244 welded to the second leg member 332 of the U-shaped member 306, and the other end 240 welded to the first leg member 330 of the U-shaped member 306 and walls of a cut out 360 in the front wall 218 of the shroud 197. The end cap 300 has the pyramidal tab 250 secured to the top wall 220 of the shroud 197.

The size of the end caps 40, 42 and 300 are not limiting to the invention. In a preferred embodiment of the invention, the first and second leg members 330 and 332 of first U-shaped member 306 were 1 inch (2.54 centimeters ("cm")) square hollow metal tubing having a length of about 24 inches (60.9 cm), and the third leg member 334 was a 2.25 inches (5.63 cm) by 1 inch (2.54 cm) hollow metal tubing having a length of 7 inches (17.78 cm). End portions of the first and second leg members 330 and 332, respectively were welded on the ends of the third leg member 334. The first and second leg members 310 and 312 of second U-shaped member 308 were 1 inch (2.54 cm) square hollow metal tubing having a length of about 18 inches (45.72 cm), and the third leg member 314 was a 2.25 inches (5.63 cm) by 1 inch (2.54 cm) hollow metal tubing having a length of 9 inches (22.86 cm). End portions of the first and second leg members 310 and 312, respectively were welded on the ends of the third leg member 314.

In the following discussion, the end caps 40 and 42 will be discussed to unitize the stack 34 of sheets 32; however, unless indicted otherwise, the discussion is applicable to the end caps having the design of the end caps 300. In the preferred practice of the invention, the end caps 40 and 42, the base 36 and the sheets 32 are biased toward one another by banding. To maintain the course of the banding around the end caps 40 and 42, the end caps are provide with a guide members and rounded rib segments. In one non-limiting embodiment of the invention, a guide member 380 was secured to upper left hand corner 381, and a guide member 383 was secured to upper right hand corner 384, of the end cap 40 (see FIGS. 2 and 7); a guide member 386 was secured to the upper left hand corner 387, and a guide member 389 was secured to the upper right hand corner 390, of the end cap 42 (see FIG. 1). The guide members 380, 383, 386 and 389 in one non-limiting embodiment of the invention each included a metal frame 392 secure to the upper corner of the end caps and a curved 0.25 inch (0.64 cm) rod 394 in the metal frame 392 (see FIG. 7) to change the course of the banding without damaging the banding. With reference to FIGS. 1, 2 and 7, as needed, in one non-limiting embodiment of the invention, a rounded rib segment 400 was secured on edge 401 below the guide member 380, a rounded rib segment 403 was secured on edge 404 below the guide member 383, a rounded rib segment 406 was secured on edge 407 below the guide member 386, and a rounded rib segment 409 was secured on edge 410 below the guide member 389. The rounded rib segments 400, 403, 406 and 409 in one non-limiting embodiment of the invention included a rounded center portion 412 between a pair of ribs 414 (Numbered in FIG. 7)

Figure 15:
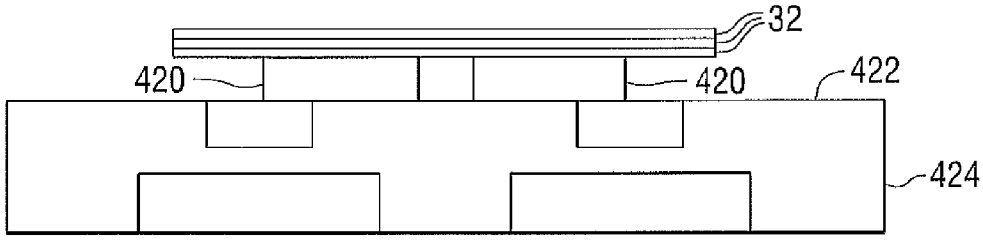
FIG. 15 is an elevated end view of a pallet having sheets stacked thereon in accordance to the teachings of the invention.
Figure 16:
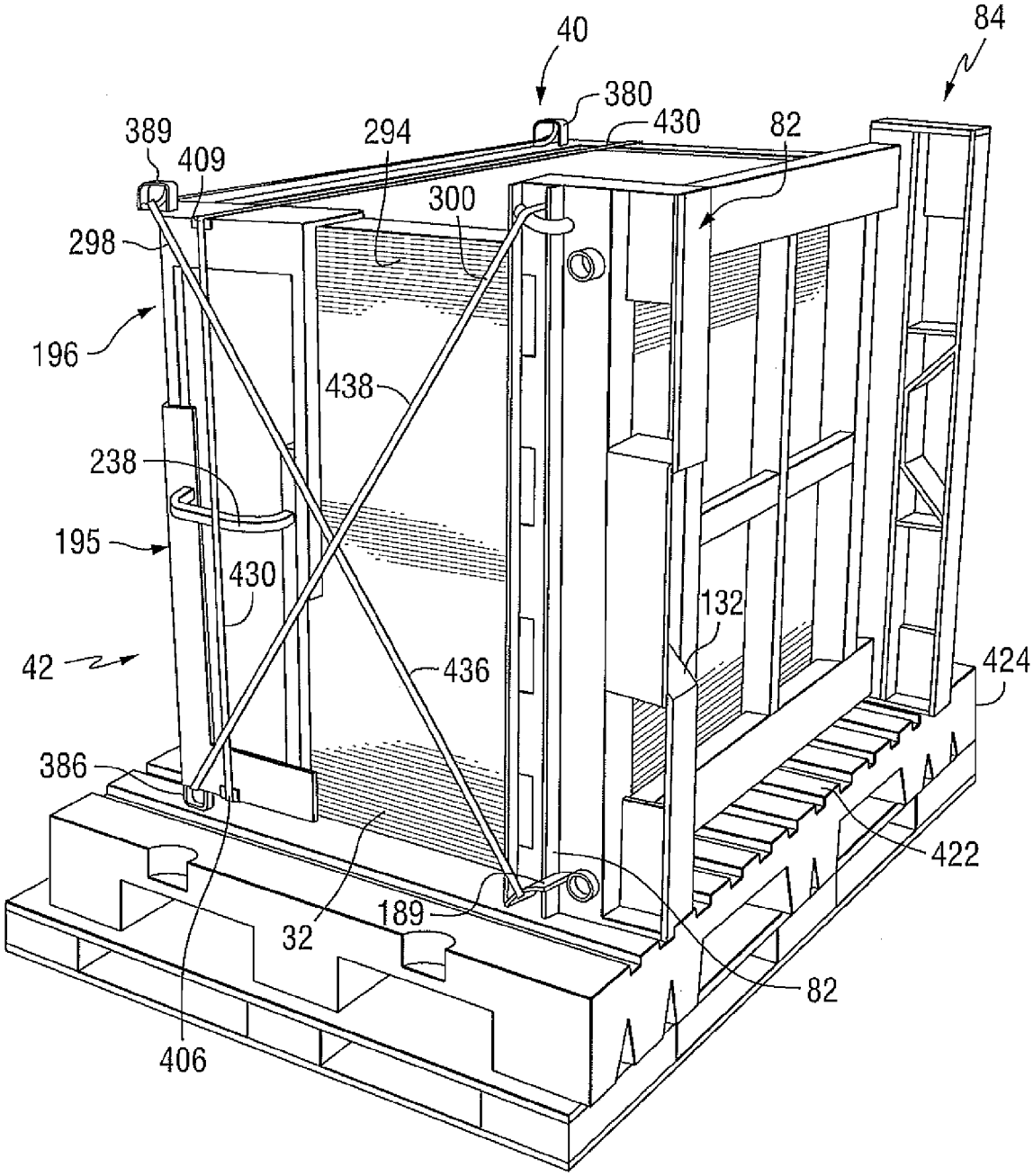
FIG. 16 is a perspective view of a non-limiting embodiment of a loaded container of the invention having the end caps, the base and the sheets unitized in accordance to the teachings of the invention; the loaded container shown in FIG. 16 is lying on a side, whereas in FIG. 1, the loaded container is in an upright position supported by the base.

In one non-limiting embodiment of the invention and with reference to FIGS. 15 and 16, the flat sheets 32 were stacked on a resilient spacer blocks 420 mounted on pallet 422 in any convenient manner with major surfaces of the sheets spaced from supporting surface 422 of the pallet 424. The plurality of sheets with their major surfaces facing the supporting surface 422 of the pallet 424 are referred to as horizontal stack of sheets. As can be appreciated, the sheets 32 can be stacked with the major surface of the sheets in the vertical position and the stacked sheets rotated 90 degrees on a rotating table (not shown) to provide a horizontal stack of sheets that is unitized in accordance to the teachings of the invention. With reference to FIGS. 15 and 16, the end cap 42 is place on one side of the horizontal stack of sheets 32 with the first section 195 of the end cap 42 resting on the surface 422 of the pallet 424. The end cap 40 is placed on the opposite side of the horizontal stack of sheets 32 with the first section 195 of the end cap 40 resting on the surface 422 of the pallet 424.

In one non-limiting embodiment of the invention, the starting point for first banding strap 430 is over the major surface of the upper most sheet of the horizontal stack of sheets shown in FIG. 16. The first banding strap 430 has its course around the rounded rib segment 409, over the handle 238, and around the rounded rib segment 406, of the end cap 42; around the major surface of the sheet facing the supporting surface 422 of the pallet 424; around the rib segment 403, over the handle 238, and around the rib segment 400, of the end cap 40; and across the upper most major surface of the horizontal stack of sheets to the starting point of the first banding 430. The first banding strap 430 was put in compression, and the ends of the banding strap were joined together as is known in the art. The banding strap 430 in compression biases the handle 238 and center portion of the end caps 40 and 42 toward the edges of the glass sheets and bias the sections of the end caps toward one another against the stack of sheets to bias the sheets toward one another.

The end restraints 82 and 84 of the base 36 are moved away from the support platform 80 to accommodate the length of the horizontal stack, and the base moved against the side of the horizontal stack to move the runners 114 against the edges of the sheets 32. The pyramidal tab 250 of the end caps 40 and 42 were aligned with the bottom center concave portion 132 of the end restraints 82 and 84. A second banding strap 436 had its starting point between the end caps 40 and 42 at the top most sheet of the horizontal stack and its course through the guide member 389 of the end cap 42 down toward the pallet and through the cut out 189 of the restraint 82 adjacent the platform 422 of the pallet 424, between the sheets and the pallet and around the cut out in the end restraint 84, upward toward and through the guide member 380 of the end cap 40 and joined to the end of the banding strap at the starting point. The second banding strap was put under compression to bias the end caps 40 and 42 and sheets toward one another, and to diagonally bias the end caps 40 and 42, the sheets and base toward one another A third banding strap 438 had its starting point between the end restraints 82 and 84 and it course around the cut out 189 in the end restart 82 downward toward and through the guide member 386 of the end cap 42, between the sheets and the pallet toward and through the guide member 386 (not shown in FIG. 16, see FIG. 1) upward away from the pallet toward the cut out 189 in the end restraint 84 and across the top of the horizontal stack to the stating end of the third banding strap. The third banding strap 438 was put under compression to bias the end caps 40 and 42 and the sheets toward one another, and to diagonally bias the end caps 40 and 42, the sheets and the base toward one another. The end caps 40 and 42, the base 36 and the sheets 32 are now unitized into a stack of sheets. As can be appreciated applying metal and plastic banding straps to unitize articles is known in the art and no further discussion is deemed necessary.

Figure 17:
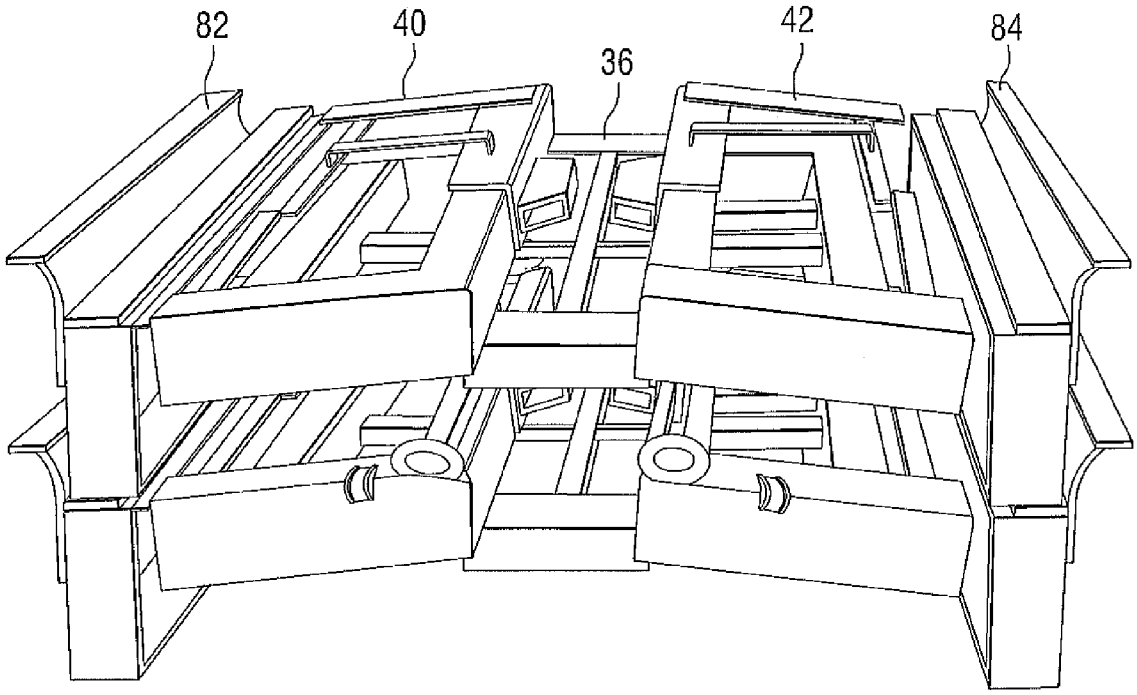
FIG. 17 is a perspective view of two nested rack assemblies one stack on top of the other in accordance to the teachings of the invention, each of the nested rack assemblies includes two end caps, and a base, incorporating features of the invention.

The pallet 424 is rotated 90 degrees and the stacked sheets 32 are moved from the horizontal stacked position shown in FIG. 16 to the vertical stacked position shown in FIGS. 1 and 2. Unitized stacked sheets are stacked on top of one another (see FIG. 2) with the pyramidal tab 250 of the end caps 40 and 42 of the lower loaded container in the pyramidal cavity 132 of the sheet edge supports 82 and 84 of the upper loaded container. The unitized sheets are separated by tilting the unitized sheets to move the second outermost sheet, e.g. the outermost back sheet against an angled back support (not shown) with the base 36 in an angle to the floor 86, e.g. about 2-3 degrees. The banding straps 430, 436 and 438 are cut in any order, and the banding and end caps 40 and 42 removed from the stacked sheets. After the glass sheets 32 are removed from the base 36, the sheet edge supports 82 and 84 are moved toward the sheet support platform 80, and the caps 40 and 42 positioned on the base 36; preferably, with the pyramidal tab 250 of the end caps face 40 and 42 facing one another and the handle 238 of the end caps 40 and 42 (see FIG. 5) facing away from the base 36 (see FIG. 17). The base 36 having the end caps 82 and 84 are mounted on top of one another with the sheet edge supports 82 and 84 of the upper container on the sheet edge supports of the lower container within the plate member 140 of the sheet edge supports 82 and 84 of the lower container as shown in FIG. 17. Optional the stacked unloaded containers can be banded together.

It can be readily appreciated by those skilled in the art that modifications can be made to the invention without departing from the concepts disclosed in the foregoing description. Such modifications are to be considered as included within the scope of the invention. For example and not limiting the invention thereto, the cut outs 189 of the end restraints 82 and 84, and the guide members 380, 383, 386 and 389 of the end caps 40 and 42 are inter-changeable. Accordingly, the particular embodiments described in detail hereinabove are illustrative only and are not limiting as to the scope of the invention, which is to be given the full breadth of the appended claims and any and all equivalents thereof.

What is claimed is:

1. A container of a unitized plurality of articles, comprising:

a base having a first base corner, a second base corner, a third base corner and a fourth base corner;

a plurality of articles stacked on the base, the stack of articles having a bottom surface on the base, a top surface opposite the bottom surface, a first surface, a second surface opposite to the first surface, a third surface between the first and second surfaces, and a fourth surface between the first and second surfaces and opposite to the third surface with a first stack corner at the juncture of the top surface, the first surface and the fourth surface, the first stack corner adjacent to and above the first base corner; a second stack corner at the juncture of the top surface, the first surface and the third surface and above the second base corner adjacent to and above the second base corner; a third stack corner at the juncture of the top surface, the second surface and the fourth surface, the third stack corner adjacent to and above the third base corner; a fourth stack corner at the juncture of the top surface, the second surface and the third surface, the fourth stack corner adjacent to and above the fourth base corner;

a first end cap mounted on marginal edge portions of the top surface of the stack adjacent the fourth side of the stack, over upper marginal edge portions of fourth side, and over the first and third stack corners;

a second end cap mounted on marginal edge portions of the top surface of the stack adjacent the third side of the stack, over upper marginal edge portions of the third side, and over the second and fourth stack corners of the stack;

a first biasing force biasing the first and second end caps toward one another, biasing the first end cap against the marginal edge portions of the first, second and fourth sides of the stack and biasing the second end cap against the first, second and third sides of the stack;

a second biasing force acting on the first end cap and the base to bias the first stack corner toward the third base corner;

a third biasing force acting on the first end cap and the base to bias the third stack corner and the first base corner toward one another;

a fourth biasing force acting on the second end cap and the base to bias the second stack corner and the fourth base corner toward one another, and a fifth biasing force acting on the second end cap and the base to bias the fourth stack corner and the second base corner toward one another, wherein the first, second, third, fourth, and fifth biasing forces unitizes the plurality of articles, the first and second end caps, and the base.

2. The container according to claim 1, wherein:

the first biasing force comprises a first banding strip having its course to bias the first end cap and the second end cap toward one another;

the second and fourth biasing forces comprise a second banding strip having its course to bias first and second end caps and the base toward one another to bias the first stack corner toward the third base corner and the second stack corner toward the fourth base corner, and the third and fifth biasing forces comprise a third banding strip having its course to bias the first and second end caps and the base toward one another to bias the third stack corner toward the first base corner and the fourth stack corner toward the second base corner.

3. The container according to claim 2, wherein:

the first banding strip is an endless banding strip and has its course around the first end cap, the second side of the stack, the second end cap and the first side of the stack;

the second banding strip is an endless banding strip and has its course around the first end cap at the first stack corner, diagonally across the fourth side of the stack toward and around the third base corner, toward and around the fourth base corner, diagonally over the third side of the stack toward and around the second end cap at the second stack corner, and over the first side of the stack to the first end cap at the first corner stack, and the third banding strip is an endless banding strip and has its course around the first end cap at the third stack corner, diagonally across the fourth side of the stack toward and around the first base corner, toward and around the second base corner, diagonally over the third side of the stack toward and around the second end cap at the fourth stack corner, and over the second side of the stack to the first end cap at the third corner stack.

4. The container according to claim 3, wherein the articles are selected from the group of wood, metal and plastic sheets, and combinations thereof, a pair of glass sheets, plastic sheets or glass and plastic sheets secured together by an interlayer material; glass units having glass sheets separated by, and secured to spacer.

5. The container according to claim 4, wherein the articles are a plurality of flat glass sheets with a peripheral edge of each of the sheets supported on the base, with a major surface of adjacent sheets in facing relationship to one another, with a major surface of an outermost sheet at one side of the stack designated as the first side of the stack of sheets and major surface of an outermost sheet at an opposite side of the stack of sheets designated as the second side of the stack of sheets.

6. The container according to claim 5, wherein the base comprises:

a support platform comprising a first side, an opposite second side, a third side between the first and second sides, and a fourth side opposite to the third side;

a first end restraint having the first and third base corners and a supporting surface defined as a first supporting surface to support marginal edges of the bottom surface of the stack adjacent the fourth side of the stack, a stop plate defined as a first stop plate extending above the supporting surface to engage marginal edge portions of the fourth side of the stack adjacent the bottom surface of the stack, the first and third base corners each including a band retention member;

a second end restraint having the second and fourth base corners and a supporting surface defined as a second supporting surface to support marginal edges of the bottom surface of the stack adjacent the third side of the stack, a stop plate defined as a first stop plate extending above the supporting surface to engage marginal edge portions of the third side of the stack adjacent the bottom surface of the stack, the second and fourth base corners each including a band retention member;

a first elongated member having one end connected to the first end restraint and an opposite second end slidably mounted in one side of the support platform; and a second elongated member having one end connected to the second end restraint and an opposite second end slidably mounted in opposite side of the base, wherein the second and third endless banding strips bias the first and second end restraints toward the support platform.

7. The container according to claim 6, wherein the band retention of the first, second, third and fourth base corners is a cut out.

8. The container according to claim 6, wherein the band retention of first, second, third and fourth band retention members has a convex surface.

9. The container according to claim 6, wherein the first end restraint further comprises a base support opposite to the first supporting surface, the base support having a groove between and spaced from the first and second ends of the first end restraint.

10. The container according to claim 9, wherein the groove has a first wall extending from the base support toward the first supporting surface, a second wall extending from the base support toward the first supporting surface with the distance between the first and second walls decreasing as the distance from the base support increases, and a third wall interconnecting the first and second walls with the third wall between the base support and the first supporting surface.

11. The container according to claim 10, wherein the support platform further comprises a pair of elongated runners having a resilient surface, with the runners spaced from one another and the resilient surfaces engaging the bottom surface of the stack of sheets.

12. The container according to claim 5, wherein the first and second end caps each comprise:

a first section comprising:

a shroud defined as a first shroud having a first cavity formed by an end wall joined to a front wall, and a top wall joined to the end wall and front wall, and a U-shaped member defined as first U-shaped member having an elongated first member, an elongated second member and a third member joining the first and second members to form the first U-shaped member, the first U-shaped member secured in the first cavity, with the third member of the first U-shaped member adjacent the end wall of the first shroud and the first leg member of the first U-shaped member adjacent the top wall of the first shroud, and a second section comprising:

a shroud defined as a second shroud having a second cavity formed by an end wall joined to a front wall, and a top wall joined the end wall and the front wall, and a U-shaped member defined as second U-shaped member having an elongated first member, an elongated second member and a third member joining the first and second members to form the second U-shaped member, the U-shaped member secured in the second cavity, with the third member of the second U-shaped member adjacent the end wall of the second shroud and the first leg member of the second U-shaped member adjacent the top wall of the second shroud, wherein the top wall and the front wall of the first shroud, and the top wall and front wall of the second shroud are sized relative to one another such that an inner surface of the top wall of the first shroud can slide over an outer surface of the top wall of the second shroud to move an edge of the top wall of the first shroud toward and away from the end wall of the second shroud and an edge of the top wall of the second shroud toward and away from the end wall of the first shroud, and the end wall of the first section of the first end cap is adjacent the third stack corner, the end wall of the second section of the first end cap is adjacent the first stack corner, the end wall of the first section of the second end cap is adjacent the fourth stack corner, and the end wall of the second section of the second end cap is adjacent the second stack corner.

13. The container according to claim 12, wherein the first U-shaped member is spaced from the inner surface of the top wall of the first shroud and inner surface of the front wall of the first shroud to provide a slit to slid the top wall and front wall of the second shroud into the first shroud under the biasing action of its respective endless banding strips.

14. The container according to claim 13, wherein the first leg of the second U-shaped member is spaced from the inner surface of the top wall of the second shroud such that the first leg of the first U-shaped member moves between the first leg of the second U-shaped member and inner surface of the top wall of the second shroud as the top wall of the first shroud moves over the top surface of the second shroud.

15. The container according to claim 14, wherein the first member and the second member of the first U-shaped members are spaced from one another, and the first member and the second member of the second U-shaped member are spaced from one another to position the second member of the first U-shaped member between the first and second members of the second U-shape member as the top wall of the first shroud moves over the top surface of the second shroud.

16. The container according to claim 15, further comprising a handle having one end connected to the second leg of the first U-shaped member and another end connected to outer surface of the shroud, wherein the first endless banding strip biases the handle of the first end cap against the fourth surface of the stack and the handle of the second end cap against the third surface of the stack.

17. The container according to claim 16, wherein a wall of the second leg of the first U-shaped member and a wall of the second leg of the second U-shaped member are in facing relationship and adjacent to one another, the wall of the second leg of the first U-shaped member or the wall of the second leg of the second U-shaped member has a groove, and the wall of the second leg of the second U-shaped member or the wall of the second leg of the first U-shaped member has a shaped member that rides in the groove as the top wall of the first shroud moves over the top surface of the second shroud.

18. The container according to claim 17, wherein surfaces of the first and second U-shaped members of the first end cap facing away from the inner surface of front wall of the first shroud of the first end cap are aligned with one another and in facing relationship to the fourth surface of the stack of sheets and surfaces of the first and second U-shaped members of the second end cap facing away from the inner surface of front wall of the first shroud of the second end cap are aligned with one another and in facing relationship to the third surface of the stack of sheets, and further comprising a layer of resilient material between the surfaces of the stack of sheets and the first and second U-shaped members of and the first and second end caps.

19. The container according to claim 12, wherein the first U-shaped member is spaced from the inner surface of the top wall of the first shroud and inner surface of the front wall of the first shroud to provide a spacing to slid the top wall and front wall of the second shroud and the first member of the second U-shaped member under the first shroud of the first and second end caps under the biasing action of the first endless banding strip.

20. The container according to claim 19, wherein the first elongated member of the first U-shaped member is between the first and second elongated members of the second U-shaped member and has a wall defined as a first facing wall facing and adjacent a wall defined as a second facing wall of the first elongated member of the second U-shaped member, and the second elongated member of the second U-shaped member is between the first and second elongated members of the first U-shaped member and has a wall defined as third facing wall facing and adjacent to a wall defined as a fourth facing wall of the second elongated member of the first U-shaped member.

21. The container according to claim 20, wherein each of the first, second, third and fourth facing walls have an elongated cut out, and further comprising:

a plurality of connector plates, each connector plate having a plate portion and a T-shaped extension, with the plate portion of a first connector plate in a free end of first elongated member of the first U-shaped member, and the plate portion of a second connector plate in a free end of the second elongated member of the first U-shaped member, with the plate portion of a third connector plate in a free end of first elongated member of the second U-shaped member, and the plate portion of a fourth connector plate in a free end of the second elongated member of the second U-shaped member, and the T-shaped extension of the first connector plate captured in the cut out of the first elongated member of the second U-shaped member, and the T-shaped extension of the second connector plate captured in the cut out of the second elongated member of the second U-shaped member, the T-shaped extension of the third connector plate captured in the cut out of the first elongated member of the first U-shaped member, and the T-shaped extension of the fourth connector plate captured in the cut out of the second elongated member of the first U-shaped member, wherein the T-shaped extensions move in their restive cut outs as the first second and the second section of the end cap move relative to one another.

22. The container according to claim 21, further comprising a handle having one end connected to the second elongated member of the first U-shaped member and another end of the handle connected to one of the following: the first elongated member of the first U-shaped member, the front wall of the first shroud, the first elongated member of the first U-shaped member and the front wall of the first shroud, wherein the first endless banding strip engages the handle of the first and second end caps to bias them toward one another against the stack of sheets.

23. The container according to claim 12, wherein each of the sections of the first and second end caps has a band retaining groove to maintain the course of the first endless banding strip, the first section of each of the end caps has a strip retaining loop to maintain the course of the second endless banding strip around the end caps, and the second section of the first and second end caps has a retaining loop to maintain the course of the third endless banding strip around the end caps.

24. The container according to claim 12, wherein the base comprises:

a support platform comprising a first side, an opposite second side, a third side between the first and second sides, and a fourth side opposite to the third side;

a first end restraint having the first and third base corners and a supporting surface defined as a first supporting surface to support marginal edges of the bottom surface of the stack adjacent the fourth side of the stack, a stop plate defined as a first stop plate extending above the supporting surface to engage marginal edge portions of the fourth side of the stack adjacent the bottom surface of the stack, the first and third base corners each including a band retention member;

a second end restraint having the second and fourth base corners and a supporting surface defined as a second supporting surface to support marginal edges of the bottom surface of the stack adjacent the third side of the stack, a stop plate defined as a first stop plate extending above the supporting surface to engage marginal edge portions of the third side of the stack adjacent the bottom surface of the stack, the second and fourth base corners each including a band retention member;

a first elongated member having one end connected to the first end restraint and an opposite second end slidably mounted in one side of the support platform; and a second elongated member having one end connected to the second end restraint and an opposite second end slidably mounted in an opposite side of the base, wherein the second and third endless banding strips bias the first and second end restraints toward the support platform.

25. The container according to claim 24, wherein the first end restraint further comprises a base support opposite to the first supporting surface, the base support having a groove between and spaced from the first and second ends of the first end restraint.

26. The container according to claim 25, wherein the groove has a first wall extending from the base support toward the first supporting surface, a second wall extending from the base support toward the first supporting surface, with the distance between the first and second walls decreasing as the distance from the base support increases, and a third wall interconnecting the first and second walls, with the third wall between the base support and the first supporting surface.

27. The container according to claim 26, wherein the support platform further comprises a pair of elongated runners having a resilient surface, with the runners spaced from one another and the resilient surfaces engaging the bottom surface of the stack of sheets.

28. A base for shipping a plurality of articles, comprising:

a support platform comprising a first side, an opposite second side, a third side between the first and second sides, and a fourth side opposite to the third side;

a first end restraint comprising a first end, an opposite second end, a supporting surface defined as a first supporting surface between the first and second ends of the first end restraint, a stop plate defined as a first stop plate extending above the supporting surface, a band retention member defined as a first band retention member adjacent the first end of the first restraint, and a band retention member defined as a second band retention member adjacent the second end of the first end restraint;

a second end restraint comprising a first end, an opposite second end, a supporting surface defined as a second supporting surface between the first and second ends of the second end restraint, a stop plate defined as a second stop plate extending above the supporting surface, a band retention member defined as a third band retention member adjacent the first end of the second restraint member, and a band retention member defined as a fourth band retention member adjacent the second end of the second end restraint;

a first elongated member having one end connected to the first end restraint and an opposite second end slidably mounted in a first end of the first side or the second side of the base to move the first restraint toward and away from the third side of the base, and a second elongated member having one end connected to the second end restraint and an opposite second end slidably mounted in an opposite second end of the first or the second side of the base to move the second end restraint toward and away from the fourth side of the base.

29. An end cap for a shipping container, comprising:

a first section comprising:

a shroud defined as a first shroud having a first cavity formed by an end wall joined to a front wall, and a top wall joined to the end wall and front wall, and a U-shaped member defined as first U-shaped member having an elongated first member, an elongated second member and a third member joining the first and second members to form the first U-shaped member, the first U-shaped member secured in the first cavity, with the third member of the first U-shaped member adjacent the end wall of the first shroud and the first leg member of the first U-shaped member adjacent the top wall of the first shroud; and a second section comprising:

a shroud defined as a second shroud having a second cavity formed by an end wall joined to a front wall, and a top wall joined to the end wall and the front wall, and a U-shaped member defined as second U-shaped member having an elongated first member, an elongated second member and a third member joining the first and second members to form the second U-shaped member, the U-shaped member secured in the second cavity, with the third member of the second U-shaped member adjacent the end wall of the second shroud and the first leg member of the second U-shaped member adjacent the top wall of the second shroud;

wherein the top wall and the front wall of the first shroud, and the top wall and front wall of the second shroud are sized relative to one another such that an inner surface of the top wall of the first shroud can slide over an outer surface of the top wall of the second shroud to move an edge of the top wall of the first shroud toward and away from the side wall of the second shroud and an edge of the top wall of the second shroud toward and away from the side wall of the first shroud.

* * * * *